US007656302B2

(12) United States Patent
Lang

(10) Patent No.: US 7,656,302 B2
(45) Date of Patent: Feb. 2, 2010

(54) SENSING CHAMBER WITH ENHANCED AMBIENT ATMOSPHERIC FLOW

(75) Inventor: Scott R. Lang, Geneva, IL (US)

(73) Assignee: Honeywell International Inc., Morristown, NJ (US)

( * ) Notice: Subject to any disclaimer, the term of this patent is extended or adjusted under 35 U.S.C. 154(b) by 310 days.

(21) Appl. No.: 11/561,532

(22) Filed: Nov. 20, 2006

(65) Prior Publication Data

US 2008/0117065 A1 May 22, 2008

(51) Int. Cl.
*G08B 17/10* (2006.01)

(52) U.S. Cl. ..... 340/628; 340/629; 340/632

(58) Field of Classification Search ..... 340/628, 340/629, 630, 632; 128/203.16, 203.27, 128/204.17, 204.22; 73/204.22, 861, 863.03, 73/25.01, 865.03; 252/70; 399/92, 94; 62/94
See application file for complete search history.

(56) References Cited

U.S. PATENT DOCUMENTS

| | | | | |
|---|---|---|---|---|
| 3,028,490 | A | 4/1962 | Guilleux | |
| 3,765,842 | A | 10/1973 | Purt | |
| 3,884,304 | A | 5/1975 | Messerschmidt | |
| 3,952,808 | A | 4/1976 | Richardson | |
| 4,035,788 | A | 7/1977 | Barr | |
| 4,099,065 | A | 7/1978 | Malinowski | |
| 4,254,414 | A | 3/1981 | Street | |
| 4,543,815 | A | 10/1985 | Troup | |
| 4,608,556 | A | 8/1986 | Cole | |
| 4,617,560 | A | 10/1986 | Gutmann | |
| 4,665,311 | A | 5/1987 | Cole | |
| 4,785,288 | A | 11/1988 | Heberlein, Jr. | |
| 4,868,546 | A | 9/1989 | Dumbeck | |
| 5,000,052 | A * | 3/1991 | Sipin | 73/863.03 |
| 5,231,378 | A | 7/1993 | Dennis | |
| 5,372,477 | A | 12/1994 | Cole | |
| 5,392,114 | A | 2/1995 | Cole | |
| 5,410,299 | A | 4/1995 | Hard | |
| 5,486,811 | A | 1/1996 | Wehrle | |
| 5,549,871 | A * | 8/1996 | Kocache et al. | 422/95 |
| 5,552,775 | A | 9/1996 | Harley | |
| 5,625,346 | A | 4/1997 | Shim | |
| 5,926,098 | A | 7/1999 | Wiemeyer | |
| 6,349,722 | B1 * | 2/2002 | Gradon et al. | 128/203.17 |
| 6,694,800 | B2 * | 2/2004 | Weckstrom et al. | 73/25.01 |
| 6,771,916 | B2 * | 8/2004 | Hoffman et al. | 399/92 |

(Continued)

FOREIGN PATENT DOCUMENTS

| | | |
|---|---|---|
| EP | 0324295 | 7/1989 |

(Continued)

OTHER PUBLICATIONS

VESDA E70-D, "Programmable Microprocessor Controlled, Self-Contained, Air Sampling Smoke Detector," 4 pages, printed Apr. 1995.

(Continued)

*Primary Examiner*—Van T. Trieu
(74) *Attorney, Agent, or Firm*—Husch Blackwell Sanders Welsh & Katz

(57) ABSTRACT

A sensing chamber promotes an inflow of ambient atmosphere by establishing an internal temperature gradiant. A closed loop control system can be provided to maintain the gradiant.

20 Claims, 1 Drawing Sheet

U.S. PATENT DOCUMENTS

| | | | | |
|---|---|---|---|---|
| 7,051,733 | B2 * | 5/2006 | Gradon et al. | 128/203.17 |
| 7,263,994 | B2 * | 9/2007 | Gradon et al. | 128/204.22 |

FOREIGN PATENT DOCUMENTS

| | | |
|---|---|---|
| EP | 0638885 | 2/1995 |
| GB | 954578 | 4/1964 |
| GB | 2277625 | 11/1994 |
| WO | WO9607166 | 3/1996 |

OTHER PUBLICATIONS

VESDA Vesda Scanner Individual Pipe Innuciating, Programmable, Microprocessor Controlled, Self-Contained, Air Sampling Smoke Detector, 4 pages, printed Apr. 1995.

VESDA "Computer Facility Fire Detection," 23 pages, printed May 1995.

Cole, Martin, Application of Electronics—Sensor Developments, 16 pages, printed May 1994.

Fenwal "AnaLaser HSSD—LTT," 6 pages, copyright 1992.

Stratos "HSSD High Sensitivity Smoke Detector Installers Handbook," 30 pages, copyright 1993.

* cited by examiner

TEMPERATURE: $T_1<T_2$
PRESSURE: $P_1<P_2$ $T_{X1}$: INFRARED LED
$R_{X1}$: PHOTODIODE

SENSING CHAMBER WITH ENHANCED AMBIENT ATMOSPHERIC FLOW

FIELD

The invention pertains to ambient condition detectors, such as smoke detectors. More particularly, the invention pertains to such detectors which include sensing chambers which promote an inflow of ambient atmosphere.

BACKGROUND

Ambient condition detectors have been found to be useful in providing an indication of the presence of the respective condition. Smoke detectors have been found useful in providing early warnings of the presence of airborne particulate matter such as smoke.

Known smoke detectors often include a housing with an internal smoke chamber. Either an ionization-type or a photoelectric-type smoke sensor can be located in the housing.

Vents are located in the housing. Ambient air circulates into and out of the housing in response to movement of the adjacent atmosphere.

Air circulation in a region being monitored does bring the airborne particulate matter into the housing. Depending on the nature of the air currents, this can be faster or a slower process.

In large commercial buildings air circulation is often achieved by centralized heating and cooling systems. Building control systems alter air flow in response to preset schedules. Hence, there may be time of minimal or no circulation such as evenings or weekends. There continues to be a need for solutions to these minimal or no circulation situations. Therefore the present invention provides a) a smoke, CO, $CO_2$ or N sensing chamber having a hollow housing having first and second regions separated by at least one flow opening, the first region, except for the at least one flow opening, does not have any outflow ports and has at least one atmospheric inflow port; and the second region, except for the at least one flow opening, does not have any inflow ports and has at least one outflow port; and a non-movable flow inducing element carried in at least one of the first or second regions of the housing to create a temperature gradient therein;

b) a detector having an aspirated sensing chamber that includes first and second regions separated by at least one flow opening and a temperature gradient between the first and second regions is the sole cause of atmospheric flow into, between and out of the chamber, the temperature gradient being provided by a non-movable flow inducing atmospheric heating element in at least one of the first or second regions of the sensing chamber; and c) a method that establishes a chamber for sensing an airborne ambient condition which includes the steps of:

separating the chamber into first and second regions by at least one flow opening;

establishing flow between the first and second regions and into the chamber wherein the flow is created solely by establishing a temperature gradient between the first and second regions of the chamber to induce an inflow of ambient atmosphere into the chamber; and sensing a concentration of the ambient condition in the chamber.

DETAILED DESCRIPTION

Figure 1:
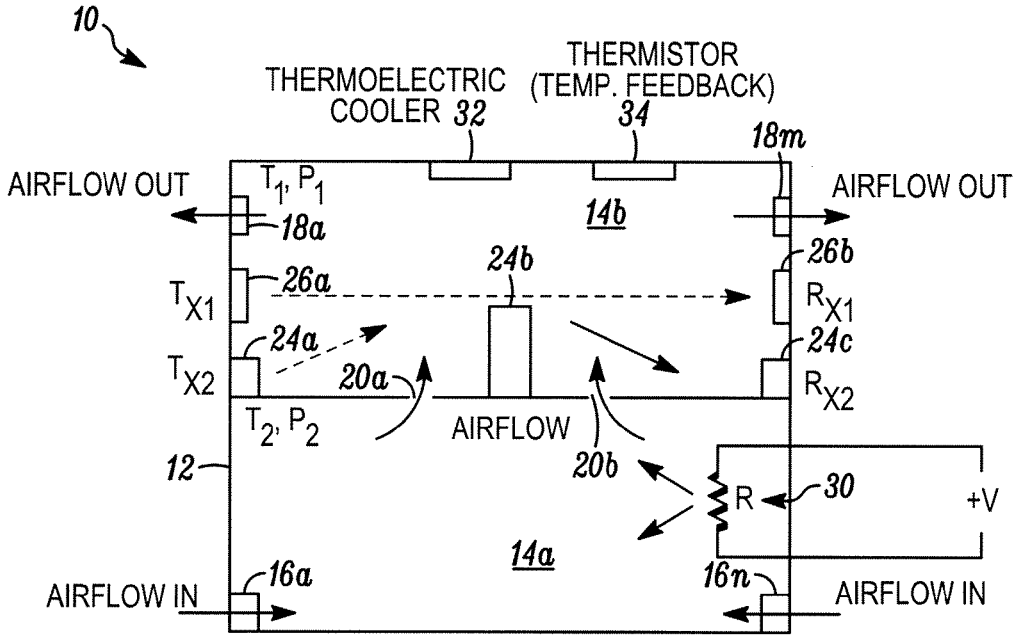
FIG. 1 is a cut-away side elevational view of a sensoring chamber in accordance with the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

FIG. 1 is a side elevational view of a photoelectric smoke sensing chamber 10 which embodies the invention. Chamber 10 includes a housing 12 which can assume a variety of shapes without departing from the spirit and scope of the invention.

Housing 12 defines interior regions 14*a, b*. Region 14*a* includes one or more atmospheric inflow ports 16*a, b - - - n*. Region 14*b* includes one or more atmospheric outflow ports 18*a, b - - - n*. One or more flow openings 20*a, b - - - l* enable ambient atmosphere to flow between regions 14*a, b*.

In one form, chamber 10 can be configured as a scattering-type smoke sensor with a source 24*a*, a light emitting (infrared for example) diode, a septum 24*b* and a sensor of scattered light 24*c*. Alternately, chamber 10 can be configured as an obscuration-type smoke sensor with a radiant energy source 26*a* and sensor 26*b*. Outputs from sensors 24*c* or 26*b* are indicative of smoke in the region 14*b*.

Those of skill in the art will recognize that the invention finds application ionization-type smoke chambers as well as gas sensing chambers (for example CO, $CO_2$, N) all without limitation.

Chamber 10 creates a temperature and or pressure gradiant between regions 14*a, b*. This gradiant promotes atmospheric in flow, via ports 16*a*, 6 - - - *n*, through openings 20*a, b - - - l* and an outflow, via ports 18*a, b - - - m*. That gradiant produces enhanced smoke, or gas detection especially in conditions of relatively still ambient atmosphere outside of chamber 10. The gradiant can be established by at least one electrical heating element 30 (preferably a static resistive element) carried in region 14*a* by housing 12.

Alternately or in addition, at least one solid state cooling element 32, (a thermoelectric cooler, for example) can be carried in region 14*b* by housing 12. A temperature sensing element 34 (a thermistor for example could also be carried in region 14*b* by housing 12. It will be understood that a plurality of elements 30, 32, 34 could be used without departing from the spirit and scope of the invention.

Figure 2:
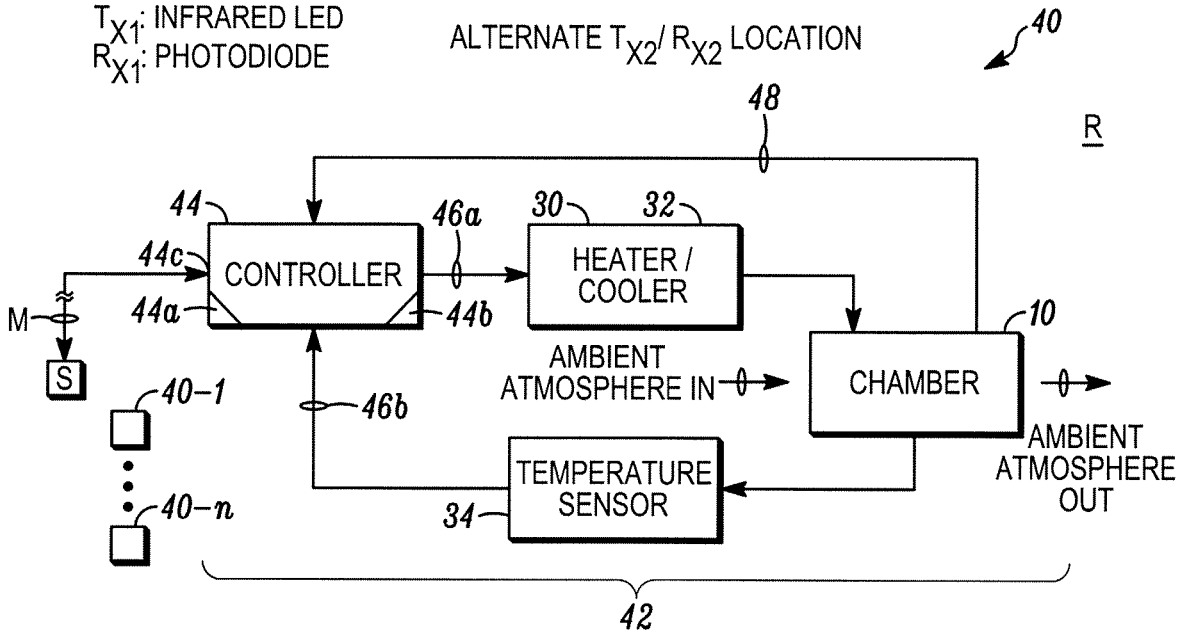
FIG. 2 is a schematic diagram of an ambient condition detector which embodies the invention.

FIG. 2 is a schematic diagram of a smoke or gas detector 40 in accordance with the invention. Detector 40 has a housing 42 which carries, in an internal region, chamber, gradiant establishing elements 30, 32 and feedback element 34. A controller 44, which could be implemented in part by at least one programmable processor 44*a* and executable control software 44*b*, produces temperature, pressure control signals 46*a* to enable heater 30 and cooling element 32 to establish the temperature or pressure gradiant(s) in chamber 10. Controller 44 also receives feedback signals 46*b* from sensor 34 to implement a closed loop control system. Those of skill in the art will understand that details of the control processing, to generate the gradiant in chamber 10 are not limitations of the invention.

Feedback signals 48 from chamber 10 couple an indicator of smoke or gas concentration to controller 44 for alarm condition processing as would be known to those of skill in the art. Controller 44, via interface 44*c*, and wired or wireless medium M can communicate with a regional alarm system S. A plurality of detector 40-1 - - - *n*, like detector 40 can be coupled to system S to monitor conditions in region R.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A smoke, Carbon Monoxide (CO), Carbon dioxide (CO2) or Nitrogen (N) sensing chamber comprising:

a hollow housing having first and second regions separated by at least one flow opening, said first region, except for the at least one flow opening, does not have any outflow ports and has at least one atmospheric inflow port;

said second region, except for the at least one flow opening, does not have any inflow ports and has at least one outflow port; and a non-movable flow inducing element carried in at least one of the first or second regions of the housing to create a temperature gradient therein.

2. A chamber as claimed in claim 1 wherein the element comprises at least one of a heating element, or a cooling element.

3. A chamber as in claim 1 which includes a temperature indicating feedback element.

4. A chamber as in claim 3 which includes a source of radiant energy and a sensor thereof.

5. A chamber as in claim 4 where the temperature gradient induces flow of ambient atmosphere into the chamber.

6. A chamber as in claim 3 which includes temperature regulating circuitry coupled to the flow inducing element and the feedback element.

7. A chamber as in claim 1, where at least one non-movable flow inducing element is located in a the first region associated with the inflow port and at least one non-movable flow inducing element is located in the second region associated with the outflow port.

8. A chamber as in claim 7 where the at least one flow inducing element located in the second region associated with the outflow port is a non-movable cooling element.

9. A chamber as in claim 7 which includes a non-movable heating element located in the first region associated with the inflow port.

10. A detector comprising:

an aspirated sensing chamber that includes first and second regions separated by at least one flow opening and a temperature gradient between the first and second regions is the sole cause of atmospheric flow into, between and out of said chamber, said temperature gradient being provided by a non-movable flow inducing atmospheric heating element in at least one of the first or second regions of the sensing chamber.

11. A detector as in claim 10, the detector having a housing which carries the chamber.

12. A detector as in claim 10 which includes closed loop temperature control circuitry.

13. A detector as in claim 12 where the chamber includes an atmospheric cooling element.

14. A detector as in claim 13 where the sensing chamber includes inflow port and an outflow port.

15. A detector as in claim 14 wherein except for the at least one flow opening between the first and second regions, the first region only contains inflow ports and the second region only contains outflow ports.

16. A method comprising:

establishing a chamber for sensing an airborne ambient condition;

separating the chamber into first and second regions by at least one flow opening;

establishing flow between the first and second regions and into the chamber only by establishing a temperature gradient between the first and second regions of the chamber to induce an inflow of ambient atmosphere into the chamber; and sensing a concentration of the ambient condition in the chamber.

17. A method as in claim 16 where establishing a temperature gradient includes heating ambient atmosphere in part of the chamber.

18. A method as in claim 17 where establishing a temperature gradient includes cooling ambient atmosphere in part of the chamber.

19. A method as in claim 16 which includes sensing a temperature parameter and adjusting the gradient accordingly.

20. A method as in claim 16 where ambient atmosphere inflows only into the first region and outflows only from the second region.

* * * * *